United States Patent [19]

Prouty

[11] Patent Number: 5,064,150

[45] Date of Patent: Nov. 12, 1991

[54] CONTROL HANDLES FOR STUNT KITES

[75] Inventor: Jonathan J. Prouty, Loveland, Colo.

[73] Assignee: Skynasaur Inc., Louisville, Colo.

[21] Appl. No.: 599,367

[22] Filed: Oct. 18, 1990

[51] Int. Cl.[5] ..... B64C 31/06

[52] U.S. Cl. ..... 244/155 A; 242/96

[58] Field of Search ..... 244/155 R, 155 A; 242/96

[56] References Cited

U.S. PATENT DOCUMENTS

| | | | |
|---|---|---|---|
| 4,172,567 | 10/1979 | Post | 242/96 |
| 4,981,271 | 1/1991 | Carter | 242/96 |

FOREIGN PATENT DOCUMENTS

| | | | |
|---|---|---|---|
| 2385422 | 3/1977 | France | 242/96 |
| 1528704 | 10/1978 | United Kingdom | 242/96 |

*Primary Examiner*—Joseph F. Peters, Jr.
*Assistant Examiner*—Linda L. Palomer
*Attorney, Agent, or Firm*—Beveridge, DeGrandi & Weilacher

[57] ABSTRACT

Two stunt kite handles are connected together by detachable couplings to form a winding frame which has oppositely extending winding posts for receiving strings wound thereabout in a figure-eight pattern. The handles are also provided with oppositely extending pivot posts which, when loosely held, permit the winding frame to pivot about a rotational axis to facilitate the release of string from the device. Each of two control strings is wound around a grip portion of its respective handle; and, both strings are wound in figure eight fashion around the winding posts.

7 Claims, 1 Drawing Sheet

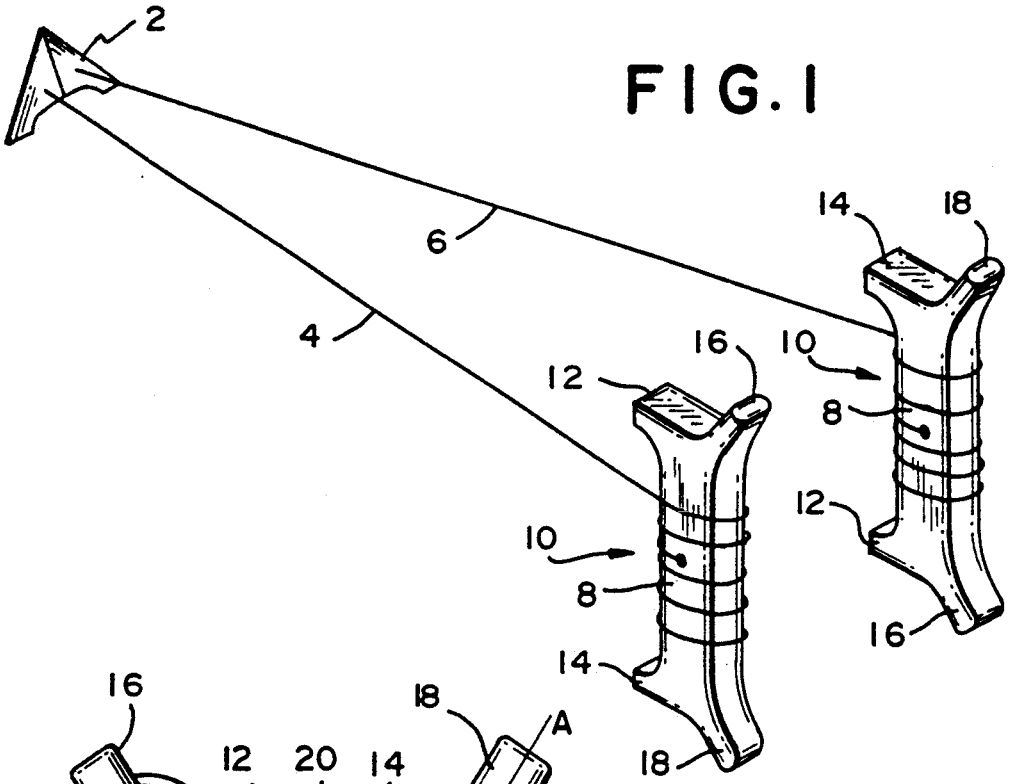
FIG. 1
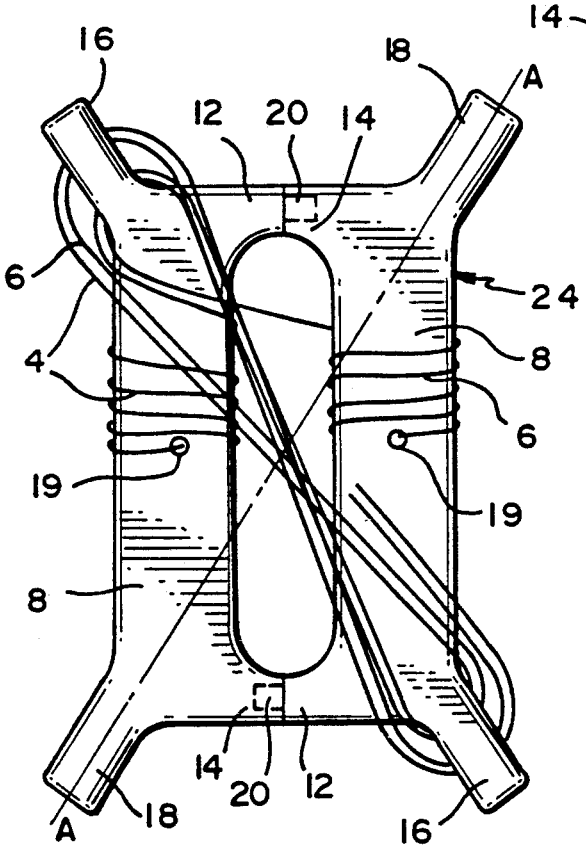
FIG. 2
FIG. 3
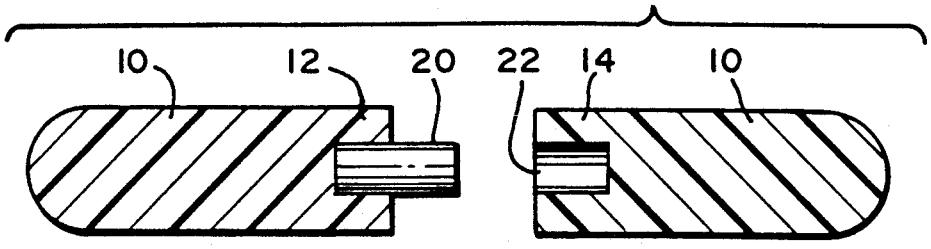

CONTROL HANDLES FOR STUNT KITES

BACKGROUND OF THE INVENTION

In recent years, the sport of flying stunt kites has expanded rapidly. As exemplified by the inventor's own U.S. Pat. No. 4,286,762, such kites normally require two control strings which extend from a pair of control handles to bridles on the kite Since the lengths of the two control strings should be substantially equal, it is desirable to have each string wound around a handle grip so that the grip can be rotated to lengthen or shorten the effective length of the control string as necessary. One inch dowels are effective grips in this regard. However, since the transverse cross section of a handle grip is inherently relatively small, it is tedious and inconvenient to wind the entire string around the grip at the conclusion of a flying session.

To expedite the task of winding up control strings, it has been previously proposed to form string-receiving notches in the ends of a handle grip, and to wind the string in a longitudinal direction in these notches. In another arrangement, both handles are connected to a rotatable member so they lie parallel to each other, and the string is wound either transversely or longitudinally around the handles and/or rotatable member. This arrangement requires the rotatable member which, as an extra element, can be lost or misplaced.

The present invention represents an improvement to kite string handles and winders. The handles themselves are coupled together to form a winding frame which is simple, convenient, and effective.

SUMMARY OF THE INVENTION

According to the invention, two handles for a stunt kite are provided with coupling means which detachably connect them together so they form a winding frame. The winding frame has two projections which extend out in opposite directions and act as winding posts around which a string is wound. Preferably, the winding frame has two other projections which act as pivot posts in that they define a rotational axis for rotation of the frame. The winding posts lie on opposite sides of the rotational axis so that when the frame is held by the pivot posts and the string is pulled, the frame will rotate about the rotational axis.

Each of the handles includes a grip portion. When flying a kite, some of the string is wound around this grip portion so that the grip may be rotated to control precisely the effective length of the control string. The grips are parallel and spaced apart when the handles are connected together in the winding frame configuration. Each handle has its coupling means located at opposite ends of the grip so that the strings wound on the grips cannot slip off the grips when the handles are connected together. The winding frame may be generally rectangular. Each handle includes one winding post projection and one pivot post projection, and these projections extend diagonally out from corners of the winding frame. Two kite strings each have a portion wound around a respective grip portion, and both of these strings are wound in a figure eight pattern around the winding post projections.

BRIEF DESCRIPTION OF THE DRAWING

FIG. 1 is a perspective view showing control handles according to the invention in use while flying a stunt kite.

FIG. 2 is a front view of the handles connected together to form a winding frame.

FIG. 3 is a sectional view as seen along the line 3—3 in FIG. 2, showing a coupling in its detached condition.

DETAILED DESCRIPTION

As shown in FIG. 1, a stunt kite 2 is being flown on two control strings 4 and 6 which are wound around the grips 8 of a pair of geometrically identical handles 10. The handles have parallel forwardly extending connector/spacer portions 12 and 14 and rearwardly diverging projections 16 and 18. The elements 12, 14, 16, and 18 effectively provide the grips with wide profile ends which reduce the risk that the strings will fall off the ends of the handles. As seen in FIG. 2, the strings are connected to each handle at transverse tie holes 19. The strings pass through the tie holes and are then knotted to form a loop which encircles half of the respective grip 8.

As shown in FIG. 3 the connector portion 12 of the left handle include a pin 20 and the connector portion 14 of the right handle has a bore 22. These elements 20 and 22 serve as a coupling which permits the two handles to be connected together as shown in FIG. 2, thus forming a winding frame 24 about which the control strings 4 and 6 can be wound.

As shown in FIG. 2, the winding frame 24 is generally rectangular, and the projections 16 and 18 extend diagonally out from its corners. The grips 8 are parallel and spaced apart, and the couplings 20, 22 are engaged. Each of the strings 4, 6 is wound around a respective grip 8, and both strings are wound in a figure eight pattern around the projections 16 which serve as winding posts. The projections 18 are diagonally opposed and they define a rotational axis A—A about which the winding frame may be rotated when unwinding the control strings from the winding frame in preparation for a flying session.

After flying a kite as shown in FIG. 1, the handles are connected together by engaging their couplings 20, 22 to form the winding frame 24 as shown in FIG. 2. Since the couplings are at both ends of the grips, the act of coupling the handles together forms a structure which prevents the string which is wound around the grips from sliding off the ends of the grips. The two strings are then brought together and wound around the winding posts 16 in the figure eight pattern shown in FIG. 2. This brings the strings in rapidly, and it sequentially introduces right twist and left twist to the strings so that the overall twist introduced by winding is substantially zero. The presence of the string presents the handles from being pulled apart and uncoupled. Throughout this procedure, the effective lengths of the strings extending from the grips are not significantly changed, so that little or no length adjustment is required at the beginning of the next flying session. The winding frame with the string on it can then be conveniently stored until the next flying session.

When preparing for the next flying session, the strings are connected to a kite, and the winding frame is held loosely by the pivot posts 18. The kite is pulled away from the frame or the frame is moved away from the kite, thus causing the frame to rotate in an oscillatory manner until the figure eight portion of the string has been fully extended. At this point, since the strings are no longer holding the two handles 10 against separation, the handles can be pulled apart for normal use in flying the kite.

The handles may be formed of conventional materials such as wood or plastic. The grips may be of any suitable cross section including elliptical, oval, rectangular, etc. A foam cushion cover may be provided around each hand grip. In this instance, each handle is made of an upper half and a lower half. A tubular body of plastic foam is slipped up onto the grip portion of the upper half, and down onto the grip portion of the lower half, and the two halves are snapped or bonded permanently together, thus providing a handle with a comfortable foam covering.

Although only one embodiment has been shown, it will be evident to persons familiar with the art that the invention may take many different forms. Thus, it is emphasized that the invention is not limited solely to the embodiment described in this specification, but is embracing of many other structures which fall within the spirit of the following claims.

I claim:

1. Two handles for controlling a stunt kite, coupling means for detachably connecting said handles together so they form a winding frame, each of said handles having a first projection, said first projections extending out from the winding frame in opposite directions to provide winding posts around which a string can be wound, each of said handles having a second projection, said second projections extending outwardly in opposite directions to provide pivot posts which define a rotational axis about which the frame may be rotated, said winding posts lying on opposite sides of said rotational axis so that said frame, when held by the pivot posts, will rotate about said rotational axis when string is pulled therefrom, said winding frame being generally rectangular, and said projections extending diagonally out from corners of said winding frame.

2. Two handles for controlling a stunt kite, coupling means for detachably connecting said handles together so they form a winding frame, each of said handles having a first projection, said first projections extending out from the winding frame in opposite directions to provide winding posts around which a string can be wound, each of said handles having a second projection, said second projections extending outwardly in opposite directions to provide pivot posts which define a rotational axis about which the frame may be rotated, said winding posts lying on opposite sides of said rotational axis so that said frame, when held by the pivot posts, will rotate about said rotational axis when string is pulled therefrom, each of said handles including one first projection and one second projection.

3. Stunt kite handles according to claim 2 wherein each of said handles includes a grip portion, said grip portions of the two handles being parallel and spaced apart when said handles are connected together by said coupling means.

4. Two handles for controlling a stunt kite, coupling means for detachably connecting said handles together so they form a winding frame, each of said handles having a first projection, said first projections extending out from the winding frame in opposite directions to provide winding posts around which a string can be wound, each of said handles including a grip portion, two kite strings wound around the grip portions of different said handles, said coupling means being located at opposite ends of the grip portions whereby the strings wound on said grip portions cannot slip off their respective grip portions when said coupling means connect the handles together.

5. Two handles for controlling a stunt kite, coupling means for detachably connecting said handles together so they form a winding frame, each of said handles having a first projection, said first projections extending out from the winding frame in opposite directions to provide winding posts around which a string can be wound, and a kite string which is wound on said winding frame in a figure-eight pattern around both of said winding posts.

6. Two handles for controlling a stunt kite, coupling means for detachably connecting said handles together so they form a winding frame, each of said handles having a first projection, said first projections extending out from the winding frame in opposite directions to provide winding posts around which a string can be wound, each of said handles including a grip portion, two kite strings which each have a portion wound around a respective grip portion, both of said kite strings also being wound around said winding posts.

7. Two handles for controlling a stunt kite, coupling means for detachably connecting said handles together so they form a winding frame, each of said handles having a first projection, said first projections extending out from the winding frame in opposite directions to provide winding posts around which a string can be wound, and a kite string which is wound around said two handles to prevent uncoupling of said handles from each other.

* * * * *